US006056918A

United States Patent [19]

Palaniappan et al.

[11] Patent Number: 6,056,918

[45] Date of Patent: May 2, 2000

[54] METHOD AND APPARATUS FOR THE STERILIZATION OF A CARTON

[75] Inventors: Sevugan Palaniappan, Grayslake; Ronald Swank, Crystal Lake, both of Ill.; Terry Erickson, St. Paul, Minn.; John Lees, Minneapolis, Minn.; John Cicha, Shoreview, Minn.; Michael Robertson, Roseville, Minn.

[73] Assignee: Tetra Laval Holdings & Finance, SA, Pully, Switzerland

[21] Appl. No.: 09/018,874

[22] Filed: Feb. 5, 1998

Related U.S. Application Data

[63] Continuation-in-part of application No. 08/911,967, Aug. 15, 1997.

[51] Int. Cl.[7] ..... A61L 2/10; A61L 2/22; B65B 3/02; B65B 43/26

[52] U.S. Cl. ..... 422/24; 422/302; 422/303; 53/458; 53/565

[58] Field of Search ..... 422/24, 37, 302, 422/303, 304; 53/425, 426, 458, 467, 565

[56] References Cited

U.S. PATENT DOCUMENTS

| | | | |
|---|---|---|---|
| 4,506,491 | 3/1985 | Joosten et al. . | |
| 4,590,740 | 5/1986 | Rodocker | 53/426 |
| 4,683,701 | 8/1987 | Rangwala et al. | 422/304 X |
| 4,963,335 | 10/1990 | Adachi et al. | 422/302 |
| 5,129,212 | 7/1992 | Duffey et al. | 422/304 X |
| 5,173,259 | 12/1992 | Bordini | 422/28 |
| 5,258,162 | 11/1993 | Andersson et al. | 422/28 |
| 5,587,127 | 12/1996 | Carlson | 422/28 |

*Primary Examiner*—Elizabeth McKanb
*Attorney, Agent, or Firm*—Welsh & Katz, Ltd.

[57] ABSTRACT

The present invention discloses a method and apparatus for sterilizing cartons with vapor-phase hydrogen peroxide and ultraviolet radiation on a packaging machine. A partially formed carton is first sprayed at a bottom forming station with a sterilant. Then, the carton is transported to a sterilization station where the carton is sprayed with gaseous hydrogen peroxide thereby allowing the gas to condense on the packaging material. The carton is then conveyed to a UV radiation source for irradiation of the packaging material. The carton is then dried with heated air to flush/remove any residual hydrogen peroxide. The present invention sterilizes the carton allowing for filling of the packaging material with a desired product such as milk, juice or water. The invention allows for the efficacious use of hydrogen peroxide having a concentration of up to 53% while providing a packaging material having less than 0.5 ppm hydrogen peroxide. The method and apparatus of the present invention allows for the fabrication of a shelf-stable food product.

20 Claims, 10 Drawing Sheets

METHOD AND APPARATUS FOR THE STERILIZATION OF A CARTON

CROSS REFERENCES TO RELATED APPLICATIONS

The present application is a Continuation-In-Part application of copending U.S. application Ser. No. 08/911,967, filed Aug. 15, 1997, which is hereby incorporated by reference.

STATEMENT REGARDING FEDERALLY SPONSORED RESEARCH OR DEVELOPMENT

Not Applicable

BACKGROUND OF THE INVENTION

1. Field of the Invention

The present invention relates to sterilization of packaging. Specifically, the present invention relates to an apparatus and method for the sterilization of a carton utilizing vapor-phase hydrogen peroxide.

2. Description of the Related Art

Milk orjuice is often packaged in cartons that have been sterilized to prolong shelf life of the contents under refrigeration. When milk or juice is being packaged under aseptic packaging conditions, the content are capable of being stored for a substantial period of time at room temperature without spoilage. Both of these packaging processes require effective sterilization of the packaging material prior to filling of a container formed from.the packaging material. For example, a container, such as a gable-top container, that has previously been formed may have its interior surfaces sterilized prior. to being filled with product. U.S. Pat. No. 4,375,145, discloses a packaging machine having a conveyor on which pre-formed cartons advance under ultraviolet germicidal solution, such as hydrogen peroxide, passing under the ultraviolet lamps.

U.S. Pat. No. 4,289,728, discloses a method for sterilization of the surfaces of food containers and other materials by applying a hydrogen peroxide solution, followed by ultraviolet radiation. This patent indicates that the peak intensity of ultraviolet radiation occurs at a wavelength of 254 nm. The concentration of the hydrogen peroxide solution is less than 10% by weight, and furthermore, the hydrogen peroxide solution is heated during or subsequent to irradiation.

UV sterilization has been shown to be suitable for sterilization of flat films but has been found to have limited applicability to preformed, angular. containers (Maunder, 1977) due to the geometric and physical constraints associated with UV light. If a simple UV lamp is placed in close proximity above a preformed, such as a gable top carton, the sterilization effectiveness is severely limited due to several reasons. The total light flux entering the carton is restricted to light that can be directed through the carton opening, which in case of typical gable top cartons are 55×55 mm, 70×70 mm or 95×95 mm. Unreflected light emitted from a line source UV lamp decreases in intensity with the square distance from.the light source. Thus, as the depth of the carton increases, the light intensity falls off.

Another problem .in sterilizing these cartons with UV light is that the light enters the top of the carton and radiates toward the bottom substantially parallel to the sides of the carton. The germicidal effect of the light that impinges on the side is very low because of the high angle incidence. Thus, the sides of the cartons are the most difficult surfaces to sterilize, especially for tall cartons. When the cartons are positioned on the conveyor, two sides of the carton lie in a plane that is parallel to the axis of the lamp, while the other two sides are transverse to the axis of the lamp. Since the lamp is elongated, radiation impinges on the transverse sides of the carton at a higher angle of incidence than it does on parallel sides of the carton. In the case of a single UV lamp source above the center of a 70×70×250 mm rectangular carton, the effective light intensity at the bottom of the carton would be reduced to 13.9% of the maximum. intensity at that distance from.the source. The carton sides transverse to the lamp axis receive light from.the entire length of the bulb. Light originating from the lamp reflector on the side opposite the parallel carton wall will have a minimum incident angle and thus have an intensity equal to 27.0% of the lamp intensity.

One ultraviolet lamp assembly that is designed to address, among other things, the problem of effective irradiation of pre-formed packages is disclosed in U.S. Pat. No. 5,433,920, to Sizer et al. In accordance with one aspect of the invention disclosed therein, an ultraviolet reflector for use with an ultraviolet lamp is utilized to effectively irradiate the sides as well as the bottom of the container.

Another problem with current sterilization practices is the limitation of concentration of hydrogen peroxide which may be used on packaging material for food. Only a minute quantity of hydrogen peroxide residue may be found on the packaging which limits most applications to less than 1% concentration.

Yet another problem with sterilization of cartons is the ability to properly sterilize those portions of the cartons which are "shadowed" by the folds of the folded bottom panels of the carton. One solution of the prior art is disclosed in U.S. Pat. No. 4,683,701 to Rangwala et al. Rangwala et al nebulizes a sterilant fog into the interior of a carton as the carton blank is being erected between the magazine and mandrel. This is the only sterilization that a carton receives as it is filled and sealed on a machine.

Yet another problem is disinfecting or maintaining the sterility of the mandrel cap of the mandrel wheel on which the carton is bottom folded prior to placement on a linear conveyor.

BRIEF SUMMARY OF THE INVENTION

On aspect of the present invention is a method for sterilization of packaging at a sterilization station on a form, fill and seal machine. The first step of the method is providing a carton blank. The next step is erecting the carton blank and placing it on mandrel of an indexing mandrel wheel. The next step is subjecting the interior of the carton bottom panels to a predetermined quantity of a sterilant at a bottom prefolding station thereby creating an interior carton bottom coated with a thin layer of the sterilant. The next step is heating the coated carton bottom at a bottom heating station. The next step is removing the folded and sealed carton from the mandrel. Another aspect of the present invention is an apparatus for sterilizing the interior bottom of a carton at the bottom forming station on a form, fill and seal machine.

It is a primary object of the present invention to provide a method and apparatus for providing an extended shelf life packaging.

It is an additional object of the present invention to provide a method and apparatus for sterilizing the interior bottom of a carton on a form, fill and seal packaging machine.

It is an additional object of the present invention to sterilize the mandrel cap of a mandrel of an indexing mandrel wheel. It is an additional object of the present invention to provide a method and apparatus for creating a shelf stable liquid food product.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a schematic view of a mandrel wheel of the present invention;

Figure 1:
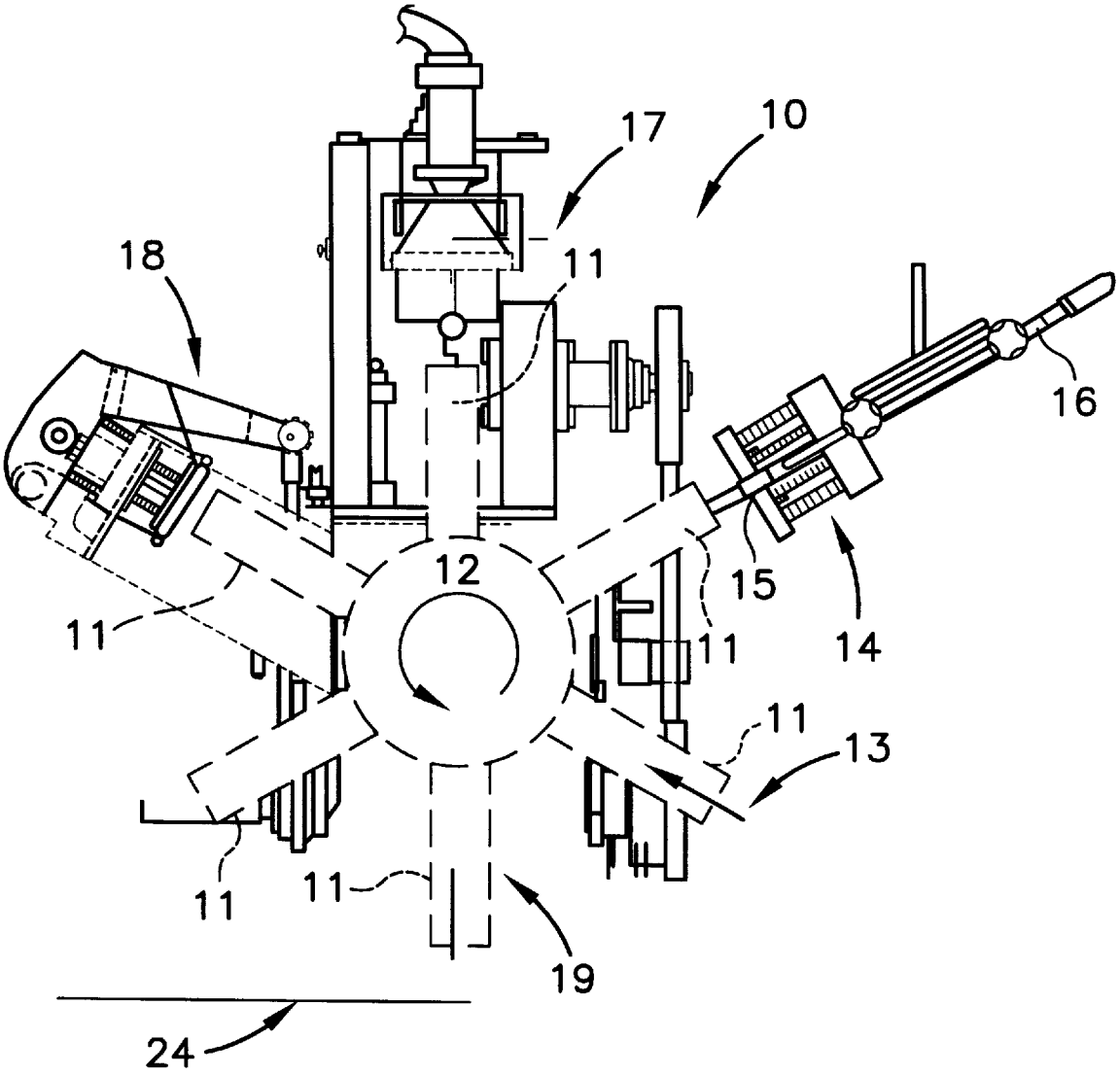
Figure 1A:
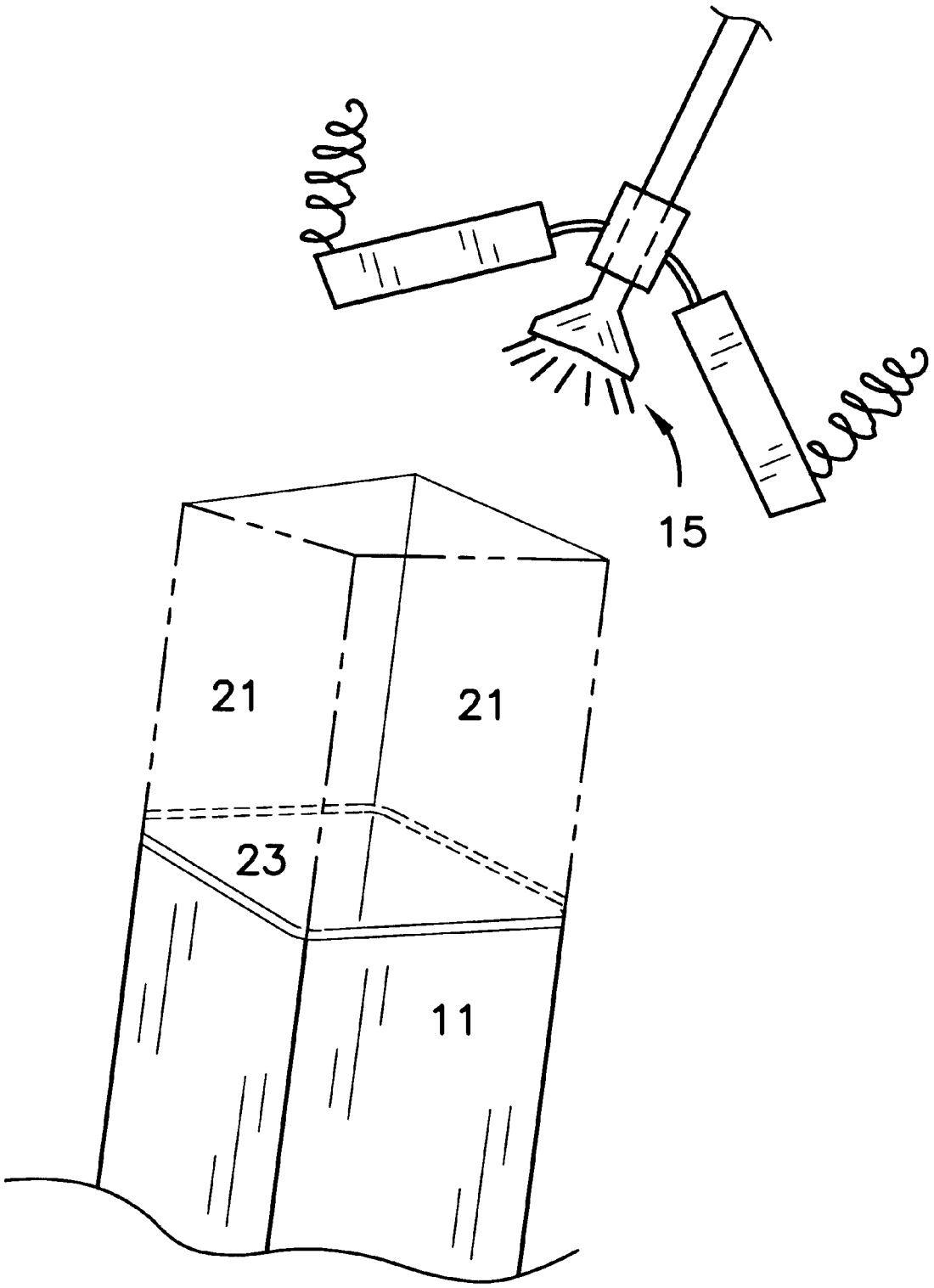
Figure 1B:
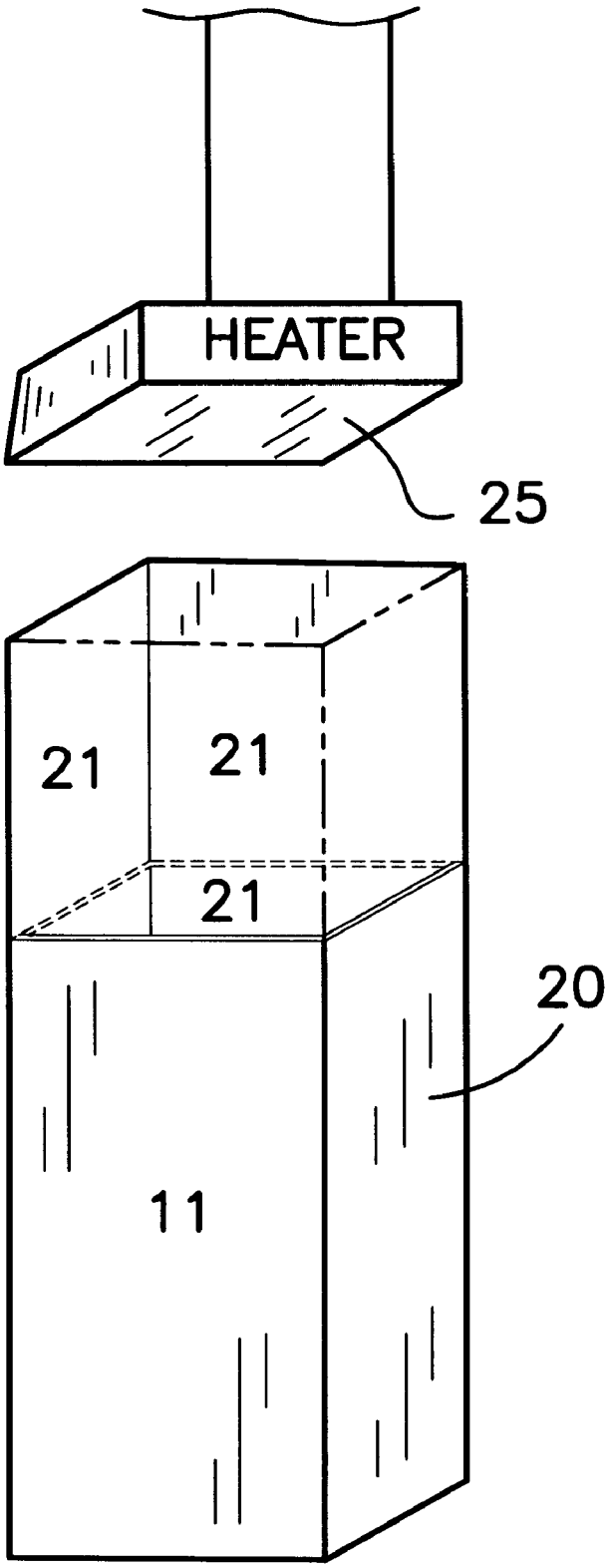
Figure 1C:
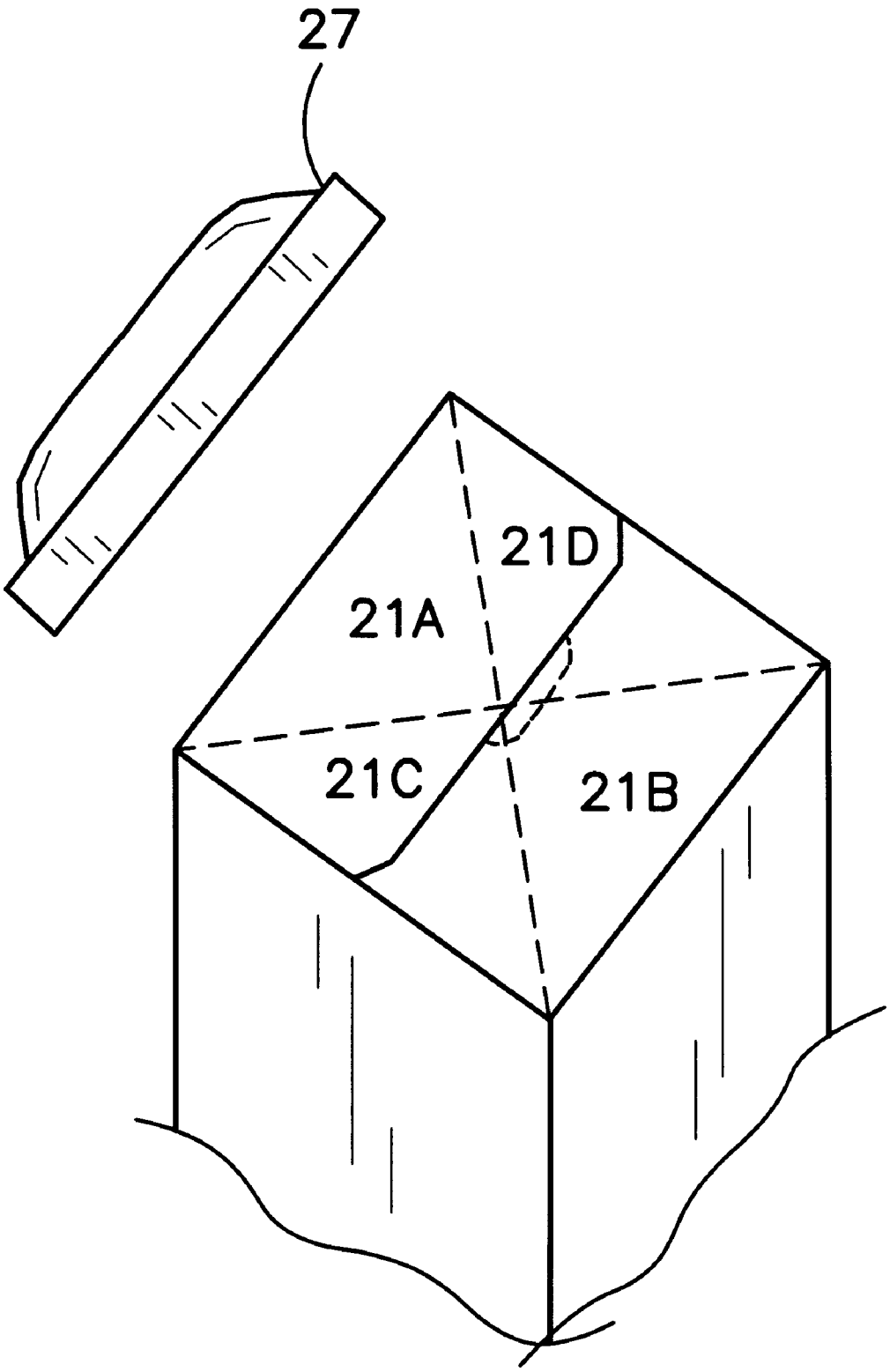
Figure 1D:
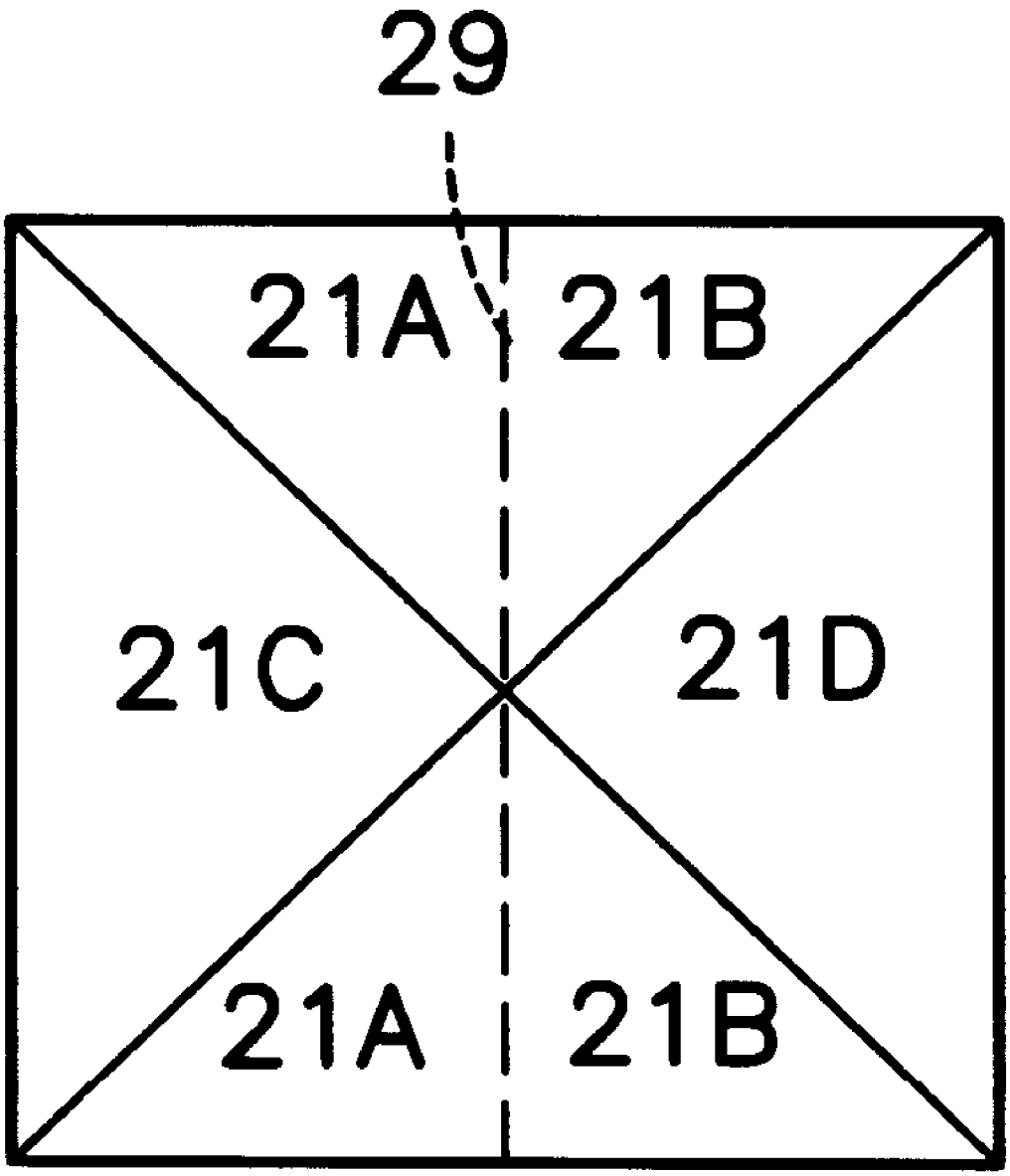
Figure 2:
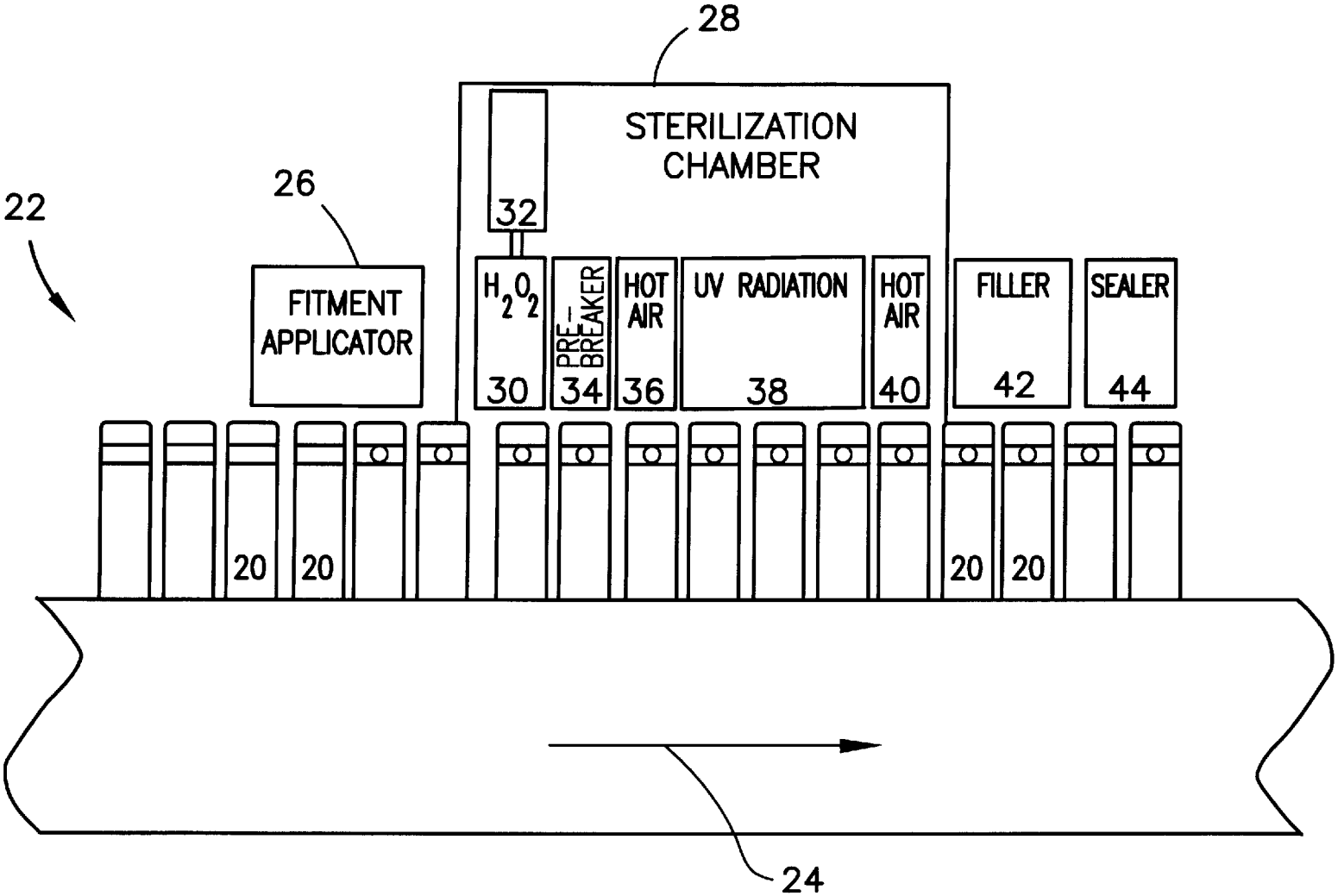
Figure 3:
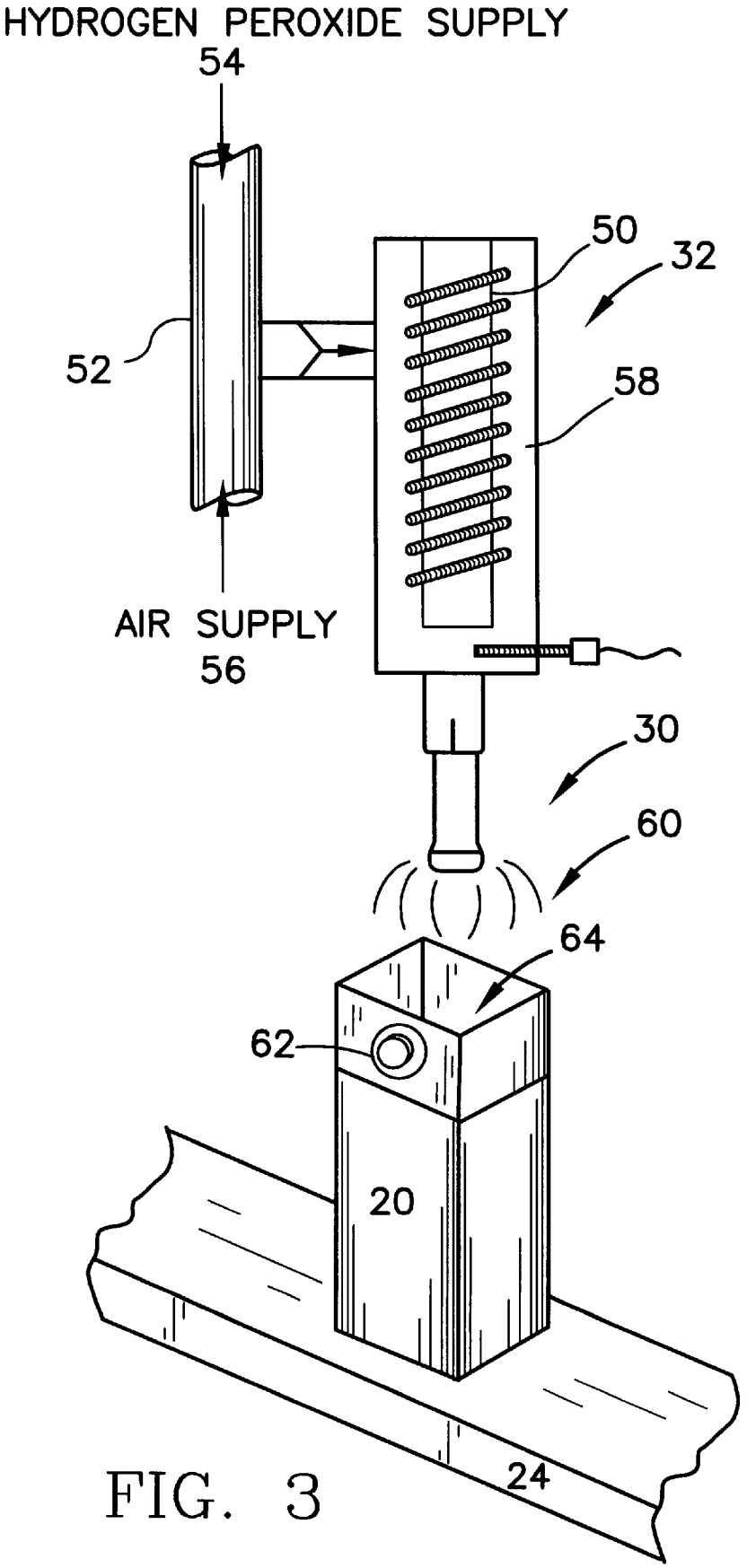
Figure 4:
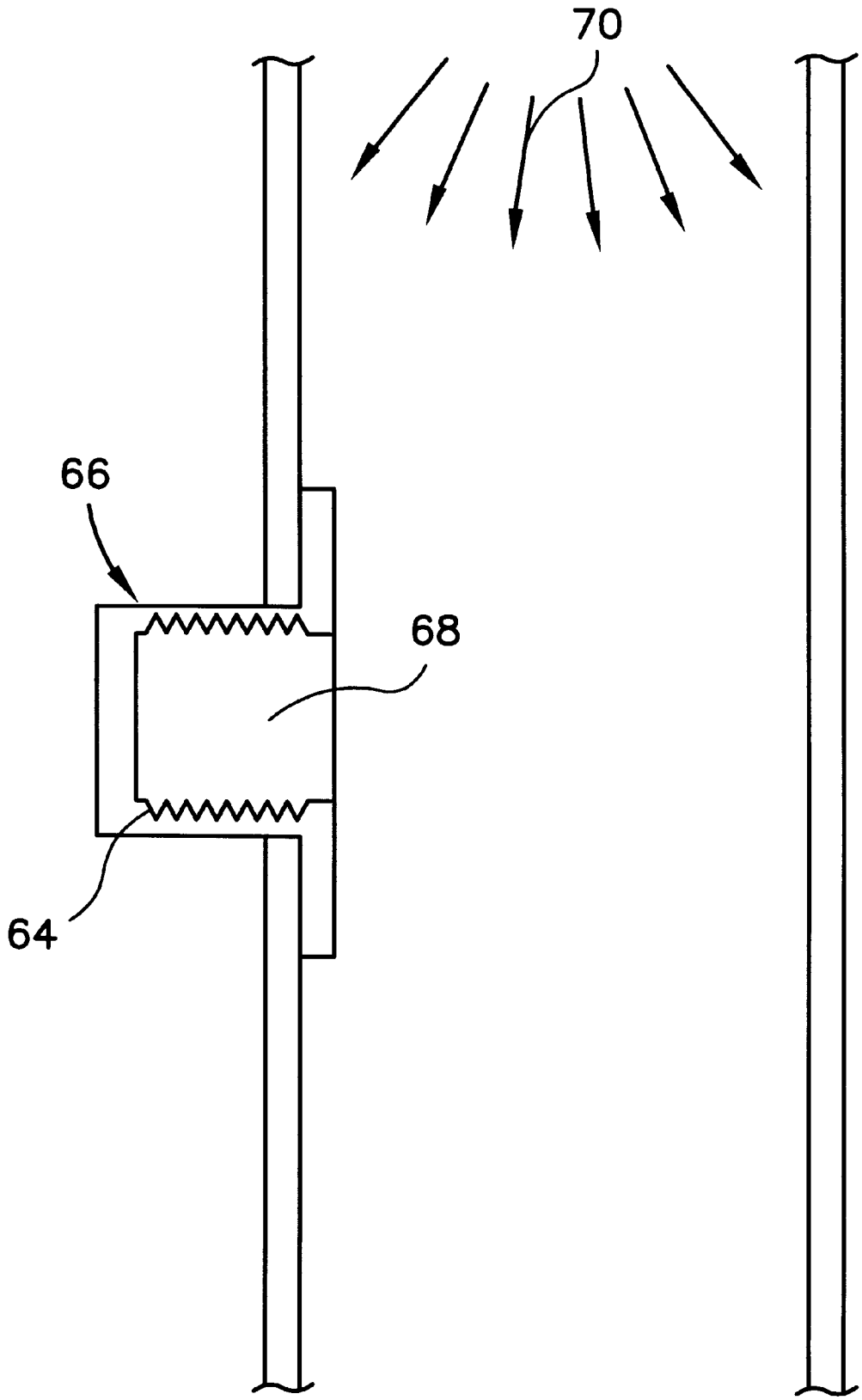
Figure 5:
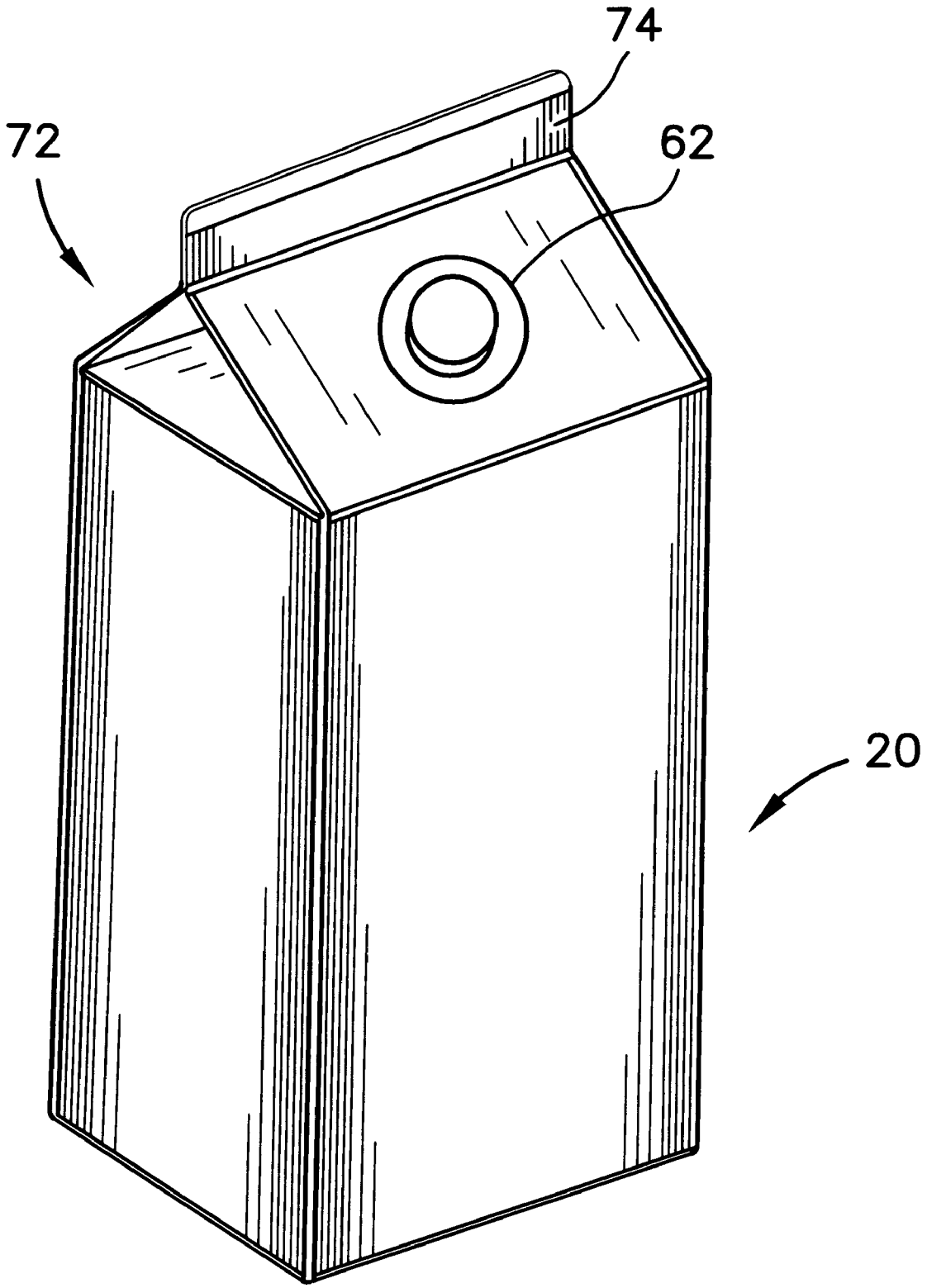
Figure 6:
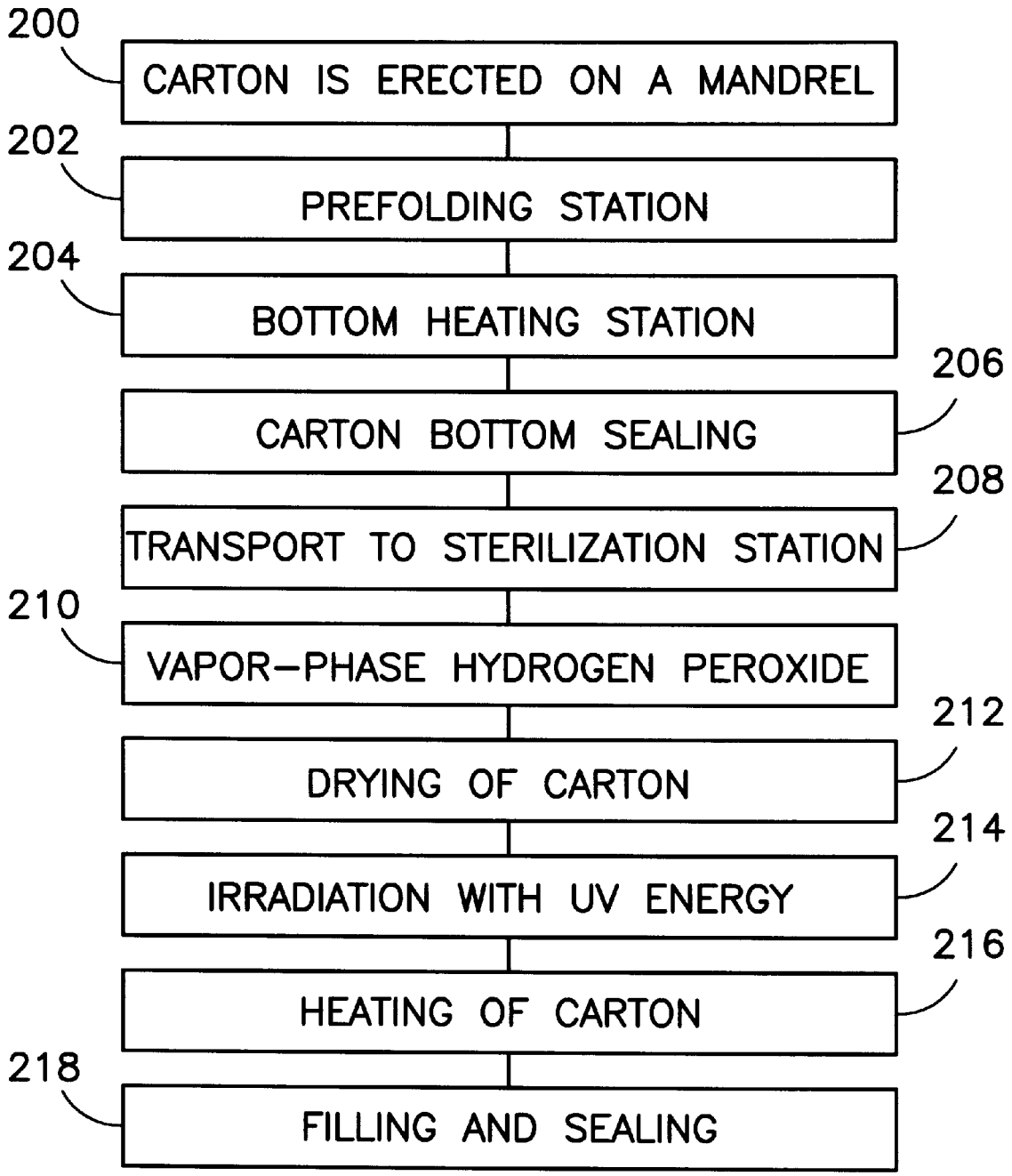

There is illustrated in FIG. 1A a cut-away section view of the prefolding station of the mandrel wheel of FIG. 1;

There is illustrated in FIG. 1B a cut-away section view of the bottom heating station of the mandrel wheel of FIG. 1;

There is illustrated in FIG. 1C a perspective view of the final folding and sealing station of the mandrel wheel of FIG. 1;

There is illustrated in FIG. 1D a plan view of the interior bottom of carton;

There is illustrated in FIG. 2 schematic view of apparatus of the present invention integrated on linear form, fill and seal packaging machine;

There is illustrated in FIG. 3 a schematic view of the vapor delivery system of the present invention;

There is illustrated in FIG. 4 a cross-sectional view of prior art sterilization using liquid hydrogen peroxide;

There is illustrated in FIG. 5 a perspective view of a carton capable of being sterilized by the present invention;

There is illustrated in FIG. 6 a flow diagram of the method of the present invention.

DETAILED DESCRIPTION OF THE INVENTION

The present invention applies to the sterilization of a partially formed carton, undergoing fabrication to an aseptic container having an extended shelf life. Such an aseptic container may take the form of a fiberboard carton such as a TETRA REX® gable top carton. An application of the present invention is with containers fabricated along a horizontal conveyance system on a multiple station form, fill and seal packaging machine such as the TR/16 TETRA REX® packaging machine available from TETRA PAK®, Inc. of Chicago, Ill. Although application of the present invention has been described in reference to fabrication with the above-mentioned containers and on the above-mentioned machine, those skilled in the pertinent art will recognize that the application of the present invention with the fabrication of other containers are well within the scope of the present invention.

As shown in FIG. 1, the indexing mandrel wheel assembly 10 includes a plurality of mandrels 11 which rotate about a central turret 12. Each of the mandrels 11 rotate from station to station at a predetermined indexed time which usually corresponds to the most time consuming station on the entire packaging machine. Usually, the most time consuming station is the top sealing station.

An erected carton is placed on a mandrel 11 at a placement station 13. The carton blank is fed from a magazine, not shown, and erected in transit to the mandrel 11. From the placement station 13, the mandrel 11 is rotated to a bottom prefolding station 14. At the bottom prefolding station 14, the bottom end panels of are "broken", that is the end panels of the carton are folded along specific score lines for facilitated sealing at a final folding and sealing station 18. At the prefolding station 14, a spray nozzle 15 sprays a predetermined amount of sterilant such as vapor phase hydrogen peroxide onto the end panels 21 and the mandrel cap 23, as further illustrated in FIG. 1A. Other possible sterilants include ozone, liquid phase hydrogen peroxide, and other peroxides. The introduction of a sterilant at the prefolding station allows for the end panels 22 to be sterilized before the end panels 22 are folded on top of each other to form the bottom of the carton 20. Once the end panels 22 are folded and sealed, sterilization is only effective on those end panels 22 which are exposed on the interior of the carton 20. Also, the introduction of sterilant at the prefolding station 11 allows for the sterilization of the mandrel cap 23 which further enhances the hygienic nature of the present invention.

From the prefolding station 11, the mandrel 11 is rotated to a bottom heating station 17. The bottom heating station heats the end panels to allow to facilitate heat sealing of the panels at the final folding and sealing station 18. The heating also activates or enhances the disinfecting action of the sterilant on the end panels 21 and the mandrel cap 23. FIG. 1B illustrates the heater 25 in relation to the end panels 21 and the mandrel cap 23.

From the bottom heating station 17, the mandrel 11 is rotated to the final folding and sealing station 18. At this station 18, the end panels 21 are folded and heat sealed together to form the bottom of the carton 20. FIG. 1C illustrates the carton after having been folded and heat sealed at the final folding and sealing station 18 by folder 27. One end panel 21A is folded on top of another end panel 21B which is folded on top of end panels 21C-D illustrated by dashed lines. Thus, after final folding, only the exposed portions of the end panels 21 on the interior of the carton 20 may be sterilized. As illustrated in FIG. 1D, end panels 21C and 21D are folded on top of end panels 21A and 21B thereby preventing sterilization of the covered portions of these end panels 21 after the bottom is formed on the mandrel wheel 10. The sterilization of the end panels 21 allows for a more thoroughly sterilized carton than provided by the prior art sterilization methods.

Referring to FIG. 2, the cartons 20 usually have a square bottom which, as mentioned above, is formed and heat sealed on the mandrel wheel 10, and then placed on a conveyor 24 which advances at a predetermined interval (indexing) to the right as viewed in FIG. 2. The cartons 20 are placed equidistant apart and advance a predetermined number of carton positions during each periodic advancing step of the conveyor. Between each advancing step of the conveyor 24, the cartons 20 generally remain stationary for processing for the predetermined interval. The predetermined interval usually corresponds to the slowest process on the line in the fabrication of the carton. The slowest process is usually the sealing of the top of the carton after filling with a desired product. A carton 20 will wait for the predetermined interval, then proceed toward the next station.

As illustrated in FIG. 2, a series of cartons 20 are partially formed on a mandrel 22 on which an end of the carton, usually the bottom, is sealed thereby by providing a carton with sidewalls, a sealed bottom and an hollow interior. The cartons 20 then proceed to a fitment applicator station 26. Other machines may not have a fitment applicator, or may apply the fitment post-processing. In such situations, the cartons 20 proceed directly to the sterilization chamber 28. If a fitment is applied, various applicators may be employed. One such applicator is described in copending U.S. patent application Ser. No. 08/filed on May 16, 1997 for a Control System And Method For A Fitment Applicator Apparatus. Another such applicator is described in U.S. patent application Ser. No. 08/710,619 filed on Sep. 20, 1996 for a Process And Apparatus For Applying Fitments To A Carton. Both copending applications are hereby incorporated by reference.

Once conveyed inside the sterilization chamber 28, each of the series of cartons are subjected to vapor-phase hydrogen peroxide from an applicator 30. The applicator 30 may be a nozzle for dispensing the hydrogen peroxide gas onto the carton 20, and in a preferred embodiment is a continuous flowing applicator. The applicator 30 flows the gas over and around the carton during the predetermined interval. The hydrogen peroxide gas condenses on the carton 20 thereby coating the carton 20 with a thin layer of hydrogen peroxide. A vaporizer 32 is disposed above of the applicator 30. The vaporizer 32 transforms a solution of hydrogen peroxide into the vapor phase by heating the solution above the gas temperature of hydrogen peroxide, 175° C. The hydrogen peroxide applicator 30 and vaporizer 32 will be further described below. Next, a pre-breaker 34 for bending the carton 20 is optionally provide not necessary to practicing the present invention. Next, a hot air distributor 36 may optionally be provided for drying the coated carton 20 before entering the next substation. However, another embodiments may not have a hot air distributor 36, and such is not necessary for practicing the present invention.

Next, each of the cartons 20 is conveyed to the ultraviolet (UV) radiation chamber 38. The chamber 38 irradiates the coated carton 20 with w radiation thereby providing a synergistic sterilization effect between V radiation and hydrogen peroxide. As shown in FIG. 2, the Uw chamber 38 is has a length of approximately three cartons 20 on the conveyor 24. Thus, as shown, the carton 20 is subjected to UV radiation for three predetermined intervals of time. The UV radiation may be UV-C, excimer UV light as described below, or the like. A possible w chamber 38 is described in copending U.S. patent application Ser. No. 08/828,927 filed on May 16, 1997 for a Ultraviolet Assembly For Use In Irradiating Containers In A Packaging Machine, which is hereby incorporated by reference. A possible reflector for dispersing the UV radiation is described in U.S. Pat. No. 5,433,920 which is hereby incorporated by reference.

Next, each of the cartons 20 is conveyed to a hot air distributor 40 for drying the cartons 20 and for flushing/removing any hydrogen peroxide residue from the cartons 20. Again, this hot air distributor 40 is optional. Once the each of the cartons 20 exits the sterilization chamber 28, only 0.5 parts per million (ppm) should be present in the cartons 20. Each of the cartons 20 are next conveyed to a filling station 42 for filling the carton with a desired product such as milk or juice. Then to a heat sealing station 44 for sealing the end of the cartons 20, usually the top, which was not sealed previously thereby creating an extended shelf life product having a defect rate of less than 1 in a thousand. Defectives is measured by spoiled product.

FIG. 3 shows the vapor delivery system of the present invention. The vapor delivery system consists of the applicator 30 and the vaporizer 32. The vaporizer 32 may be a heat exchanger 50 which receives air and hydrogen peroxide through a conduit 52. The conduit is in flow communication with a hydrogen peroxide source 54 and an air supply 56. As the liquid solution of hydrogen peroxide enters the chamber 58 of the vaporizer 32, it is heated to a temperature in excess of 175° C., the vaporization temperature of hydrogen peroxide. In an alternative embodiment, the vaporizer may transform the solution of hydrogen peroxide into vapor through increasing the pressure instead of the temperature.

The vapor phase hydrogen peroxide flows through a second conduit 59 to the applicator 30 where it is sprayed onto a carton 20 as illustrated by arrows 60. The applicator may be a nozzle with a distribution of openings sufficient to widely disperse the gas. When the gas exits the applicator, its temperature has decreased to 80–90° C. The flow of hydrogen peroxide is continuous in a preferred embodiment, however, it is within the scope of the present invention to have intermittent spraying of the hydrogen peroxide gas.

The hydrogen peroxide gas enters and condenses on the opened interior 64 of the carton 20, the exposed exterior of the carton 20, and also condenses on the fitment 62. The condensation temperature for hydrogen peroxide is 60° C. As previously stated, the carton is stationary for the predetermined interval during which a predetermined amount of hydrogen peroxide gas condenses on the carton 20. For example, the predetermined interval may be 1.2 seconds.

Notable the present invention sterilizes the interior portion of the spout assemblies/fitment 64. In this respect, it is noted in FIG. 4 that each spout assembly may be functionally comprised of two sections: an exterior section 66, that, upon application to the respective carton 20 is disposed toward the exterior of the carton 20; and, an interior section 68 that, upon application to the respective carton 20 is disposed toward the interior of the carton 20. Generally, as illustrated in FIG. 4, sterilization of the interior sections of the spout assemblies/fitments 64 is neglected in that the interior sections 68 are difficult to access once the spout assemblies/fitments 64 have been attached to the respective carton 20. For example, a dispersion of liquid hydrogen peroxide, illustrated with arrows 70, fails to reach certain interior portions of the spout assembly/fitment 64. Such regions effectively become "shadowed" regions that do not receive an application of hydrogen peroxide. Accordingly, post-attachment container sterilization with liquid hydrogen peroxide frequently leaves substantial portions of the spout assembly in a septic state that may contaminate the contents of the carton, and thereby lowering its effective shelf life. By spraying gaseous hydrogen peroxide into and around the carton, such problems are reduced or eliminated.

There is shown in FIG. 5 a fully formed, sealed and filled gable top carton 20 fabricated using the present invention. The carton has the familiar gable top 72 which is accented by the top fin 74. The top fin is either heat sealed or ultrasonically sealed to prevent contamination of the carton 20 and the desired product contained therein. The fitment 62 is provided to access the contents of this carton 20, however, more traditional cartons would have an integrated pour spout accessed by tearing open a portion of the gable top 72.

There is illustrated in FIG. 6 a flow diagram of the method of the present invention. At step 200, a carton blank is erected and placed on a mandrel. At step 202, the erected carton blank is rotated to a prefolding station on a mandrel wheel where the carton blank is subject to a predetermined quantity of a sterilant. At step 204, the erected carton is rotated to a bottom heating station on the mandrel wheel and the bottom is heated thereby enhancing the sterilant. At step 206, the bottom of the carton is sealed thereby creating a partially-formed carton. At step 208, the partially-formed carton is transported to a sterilization station. At step 210, the partially-formed carton is subjected to a predetermined quantity of a vapor-phase hydrogen peroxide. At step 212, the partially-formed carton may be optionally dried/heated. At step 214, the partially-formed carton is irradiated with UV radiation, UV-C, excimer, or the like. The irradiation is sufficient to sterilize the material. At step 216, the partially-formed carton may be heated in order to dry the material and to flush/remove any residue of hydrogen peroxide. The material should have less than 0.5 ppm of hydrogen peroxide. At step 218, the sterilized partially-formed carton is filled and then sealed.

The present invention will be described in the following examples which will further demonstrated the efficacy of the novel sterilization method and apparatus, however, the scope of the present invention is not to be limited by these examples.

Test Methodology

A. Spore Reduction Test

A 50 $cm^2$ area in the bottom of the second panel was used to spread 10 $\mu$L of $10^7$ spores/ml. A swab application and recovery method was used for this test. A sterile carton swab was dipped in sterile phosphate buffer, squeezed against the side of the test tube, and used to spread the 10 $\mu$L drop over the selected area. The inoculated cartons were allowed to dry for at least two hours under the laminar flow hood. One wet and one dry sterile cotton swabs were used to recover the spores from.the test cartons after the treatment, in a similar manner. The test tubes containing the buffer and the swabs were vortexed and allowed to sit for one hour before sampling. Appropriate dilutions were plated using Plate Count Agar (PCA) and incubated at 32° for 48 hours.

B. Inoculated Pack Test Procedure

1. Inoculate cartons by spray method with appropriate log load.
2. Run test cartons through filling machine and fill with sterile milk.
3. Incubate inoculated filled cartons at 32° for ten days.
4. Streak 10 $\mu$L of product from each package on PCA plates.
5. Measure pH of inoculated samples and inspect for off odors and/or curdling.
6. Incubate PCA plates for 24 to 48 hours at 32° C.
7. A positive is a streak with confirmed BsA growth.

TABLE 1

Spore reduction test results

| Test Conditions | Log Reduction* | No. of Cartons |
|---|---|---|
| 35% $H_2O_2$ vapor + hot air (no UV) | 3.5 - not a total kill | 20 |
| 35% $H_2O_2$ + UV + hot air | >4.5 | 20 |
| 35% $H_2O_2$ + hot air + UV | >4.5 | 10 |
| 15% $H_2O_2$ + hot air + UV | >4.5 | 10 |
| 2% $H_2O_2$ + hot air + UV | >4.5 | 10 |
| 2% $H_2O_2$ + UV + hot air | >4.5 | 10 |
| 0.5% $H_2O_2$ + UV + hot air | 4.4 - not a total kill | 10 |

*Each variable had ten cartons
Average recovery from ten positive controls is 4.5 log

TABLE 2

Inoculated pack test results

| Test # | Test Conditions | Log Load | Results |
|---|---|---|---|
| 1 | Non-screw cap, 35% $H_2O_2$ Vapor, Hot air after UV light | 2 | No positives |
| 2 | Screw cap, Same as #1 | 2 | No positives |
| 3 | Non-screw cap, same as #1 | 3 | No positives |
| 4 | Screw cap, Same as #1 | 3 | No positives |
| 5 | Non-screw cap, Same as #1 | 4 | 6/20 positives |
| 6 | Screw cap, same as #1 | 4 | 6/20 positives |
| 7 | Non-screw cap, same as #1 | 5 | 17/20 positives |
| 8 | Non-screw cap, 2% $H_2O_2$ vapor Hot air after UV | 4 | 12/18 positives |
| 9 | Non-screw cap, 35% $H_2O_2$ vapor Hot air before UV | 2 | No positives |
| 10 | Non-screw cap, same as #9 | 3 | No positives |
| 11 | Non-screw cap, same as #9 | 4 | 4/10 positives |

Statistical Analysis

A. Results from 2, 3 and 4 log tests

Log Cycle Reduction (LCR) 4.5

Lower limit 4.4

Higher limit 4.8

Confidence interval 9.5%

Maximum probability 3.127

Likelihood (>95% is meaningful result 30%

Results using 2, 3, 4 and 5 log tests

LCR (95% confidence level) 4.6

Lower limit 4.5

Higher limit 4.8

Likelihood (very significant) 69.3%

These results show that 35% $H_2O_2$ Vapor and UV System is capable of delivering a 4.5 log reduction on Bacillus subtilis A spores. This is the first time ever the results were meaningful and very significant with ≧95% confidence level.

SUMMARY

Existing $H_2O_2$—UV System on Tetra Rex machines was improved by changing over to vapor instead of liquid $H_2O_2$. Vapor introduces improved and uniform coverage throughout the cartons. Droplets and excess peroxide in the package are eliminated. This improves the sterilization capability of the system which could be noticed by comparing 0.5% $H_2O_2$ vapor versus liquid.

It is clear that it is the total number of $H_2O_2$ molecules available for reaction which is critical. Hence, higher concentration of $H_2O_2$ than 0.5% can be used at a lower flow rate to obtain a similar or better log reduction. The results obtained from hot air before and after UV exposure did not show any significant difference. This is because the spore load applied was not high enough to obtain a difference. The interesting thing is that hot air applied before UV could remove the excess $H_2O_2$ (if there is any) and let UV light produce free radicals from $H_2O_2$ penetrated/attached to the spores. This could be effective since the radicals are generated closer or inside the spores to inactivate them in a short time.

These tests show that the results obtained from spore reduction tests are different from (lower than) inoculated pack tests. Inoculated pack test with milk is a tough test for refrigerated or ESL products. However, it is a realistic test because Tetra Rex cartons have shadow areas and cracks. Applying spores in one flat area and treating the carton does not challenge the UV—$H_2O_2$ System appropriately. Inoculated pack test with proper statistical analysis should be used as a final test for gable-top cartons to determine a conservative log reduction.

The results also show that there is no limit on concentration of $H_2O_2$ for spore inactivation as reported in a few earlier research papers. Absorption of UV by (high concentration) $H_2O_2$ and/or multiple spore layers could be the reason for reduced or no kill results. This was previously proven by applying UV light from the opposite side of the spore +$H_2O_2$ side of high transmittance polyethylene materials. A linear relationship was developed between concentration $H_2O_2$ (up to 35%) and log spore reduction This result can be used to conclude that a thin layer of $H_2O_2$ is required for effective sporicidal action of $H_2O_2$—UV System. Current study using $H_2O_2$ vapor for an application of thin layer confirms that increased spore reduction can be achieved by increasing the concentration.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claim as our invention:

1. A method for sterilization of cartons on a form, fill and seal packaging machine, the method comprising:

providing a plurality of carton blanks to be erected at a mandrel wheel of the packaging machine;

erecting each of the plurality of carton blanks and placing each of the plurality of carton blanks on a mandrel of the mandrel wheel;

subjecting each of the plurality of erected carton blanks to a predetermined quantity of a sterilant while on the mandrel at a pre-folding station;

sealing the bottom of each of the plurality of erected carton blanks to create a partially-formed carton;

conveying each of the plurality of partially-formed cartons from the mandrel wheel to a sterilization station;

subjecting each of the plurality of partially-formed cartons to a predetermined quantity of vapor-phase hydrogen peroxide at the sterilization station;

irradiating each of the plurality of partially-formed cartons with ultraviolet radiation for a predetermined set of time at the sterilization station; and drying each of the plurality of partially-formed cartons.

2. The method according to claim 1 wherein the step of drying each of the plurality of partially-formed cartons is carried out subsequent to subjecting each of the plurality of partially formed cartons to a predetermined quantity of vapor-phase hydrogen peroxide at the sterilization station.

3. The method according to claim 1 wherein the step of drying each of the plurality of partially-formed cartons is carried out subsequent to irradiating each of the plurality of partially formed cartons.

4. The method according to claim 1 further comprising placing a fitment on each of the plurality of partially-formed cartons at a fitment station disposed prior to the sterilization station and subjecting each of the plurality of partially-formed cartons to a predetermined quantity of vapor-phase hydrogen peroxide including subjecting the interior of the carton and the exposed exterior of the carton as well as the fitment to the predetermined quantity of vapor-phase hydrogen peroxide.

5. The method according to claim 1 wherein the vapor-phase hydrogen peroxide has a concentration lower than 53%.

6. The method according to claim 1 further comprising heating each of the plurality of erected carton blanks on the mandrel subsequent to subjecting each of the plurality of erected carton blanks to a predetermined quantity of a sterilant while on the mandrel.

7. The method according to claim 1 wherein subjecting each of the plurality of erected carton blanks to a predetermined quantity of a sterilant occurs at a pre-folding station on the mandrel wheel.

8. The method according to claim 7 further comprising drying each of the plurality of erected carton blanks at a bottom panel heating station on the mandrel wheel subsequent to subjecting each of the plurality of erected carton blanks to a predetermined quantity of a sterilant.

9. The method according to claim 1 further comprising filling each of the plurality of partially-formed cartons with a product subsequent to irradiating each of the plurality of partially-formed cartons with ultraviolet radiation.

10. The method according to claim 9 further comprising sealing the top of each of the plurality of partially-formed cartons to create a shelf stable product.

11. A sterilization arrangement on a form, fill and seal packaging machine, the packaging machine having a mandrel wheel with a plurality of mandrels thereon and a sterilization station, the sterilization arrangement comprising:

a carton bottom panel pre-folding station disposed about the mandrel wheel, the carton bottom panel pre-folding station having a sprayer for subjecting each of the plurality of erected carton blanks to a predetermined quantity of a sterilant while the erected carton blank is on a mandrel of the mandrel wheel;

a bottom sealing station disposed about the mandrel wheel to seal the bottom of each of the plurality of erected cartons to create a partially-formed carton;

means for moving each of the plurality of partially formed cartons to the sterilization station;

a sprayer for subjecting the packaging to a predetermined quantity of vapor-phase hydrogen peroxide, the sprayer disposed above each of the plurality of cartons within the sterilization station;

an ultraviolet radiation source for irradiating each of the plurality of partially-formed cartons with ultraviolet radiation for a predetermined set of time, the ultraviolet radiation source downline from the sprayer; and a hot air distributor capable of flowing hot air onto each of the plurality of partially-formed cartons.

12. The sterilization arrangement according to claim 11 wherein each of the plurality of partially formed cartons has a spout thereon whereby subjecting each of the plurality of partially formed cartons to a predetermined quantity of vapor-phase hydrogen peroxide subjects the interior of the carton and the exposed exterior of the carton as well as the fitment to the predetermined quantity of vapor-phase hydrogen peroxide.

13. The sterilization arrangement according to claim 11 wherein the vapor-phase hydrogen peroxide has a concentration lower than 53%.

14. The apparatus according to claim 11 wherein the vapor-phase hydrogen peroxide has a concentration of 35%.

15. The apparatus according to claim 11 further comprising means for vaporizing hydrogen peroxide, the vaporizing means in flow communication with the sprayer.

16. The apparatus according to claim 11 wherein the moving means is a conveyor assembly indexed to move at a predetermined interval.

17. The apparatus according to claim 11 further comprising a bottom heater at a bottom panel heating station about the mandrel wheel, the bottom-heater drying the sterilant.

18. The apparatus according to claim 11 wherein the hot air distributor is disposed between the sprayer and the ultraviolet radiation source.

19. The apparatus according to claim 11 wherein the moving means transports each of the plurality of partially-formed cartons in an indexed movement, a dwell time corresponding to a predetermined amount of time between each indexed movement, each of the plurality of partially-formed cartons subject to one dwell time at the sprayer and three dwell times at the ultraviolet radiation source.

20. A sterilization arrangement on a form, fill and seal packaging machine, the packaging machine having a mandrel wheel with a plurality of mandrels thereon, a fitment application station, a sterilization station and a filling station, the sterilization arrangement comprising:

a carton bottom panel pre-folding station disposed about the mandrel wheel, the carton bottom panel pre-folding station having a sprayer for subjecting the interior bottom panels of each of a plurality of erected carton blanks to a predetermined quantity of a sterilant while the erected carton blank is on a mandrel of the mandrel wheel;

a bottom sealing station disposed about the mandrel wheel to seal the bottom of each of the plurality of erected cartons to create a partially-formed carton;

means for moving each of the plurality of partially formed cartons to the sterilization station;

a sprayer for subjecting the packaging to a predetermined quantity of vapor-phase hydrogen peroxide, the sprayer disposed above each of the plurality of cartons within the sterilization station, the sprayer subjecting the interior and the exposed exterior of each of the plurality of partially-formed cartons and the fitment to the predetermined quantity of vapor-phase hydrogen peroxide;

an ultraviolet radiation source for irradiating each of the plurality of partially-formed cartons with ultraviolet radiation for a predetermined set of time, the ultraviolet radiation source downline from the sprayer, the ultraviolet radiation disposed above each of the plurality of partially-formed cartons and having a reflector for transmitting incident radiation toward the interior of each of the plurality of partially-formed cartons; and a hot air distributor capable of flowing hot air onto each of the plurality of partially-formed cartons.

* * * * *